US007469521B2

(12) United States Patent
Cheaure et al.

(10) Patent No.: US 7,469,521 B2
(45) Date of Patent: Dec. 30, 2008

(54) RESEALABLE PACKAGE

(76) Inventors: Sarah F. Cheaure, 221 N. Lucia, Unit #2, Redondo Beach, CA (US) 90277; Michael J. Cheaure, 221 N. Lucia, Unit #2, Redondo Beach, CA (US) 90277

( * ) Notice: Subject to any disclaimer, the term of this patent is extended or adjusted under 35 U.S.C. 154(b) by 0 days.

(21) Appl. No.: 11/784,531

(22) Filed: Apr. 5, 2007

(65) Prior Publication Data

US 2007/0246378 A1 Oct. 25, 2007

Related U.S. Application Data

(62) Division of application No. 10/747,629, filed on Dec. 29, 2003, now Pat. No. 7,204,368.

(51) Int. Cl.
*B65B 43/00* (2006.01)

(52) U.S. Cl. ..... 53/452; 53/412; 53/455; 53/469

(58) Field of Classification Search ..... 53/412, 53/450, 452, 455, 469, 133.4, 139.2, 558, 53/570, 237, 238, 246; 383/38, 39, 40
See application file for complete search history.

(56) References Cited

U.S. PATENT DOCUMENTS 3,358,416 A * 12/1967 Schneider et al. ..... 53/452
3,411,264 A * 11/1968 Farquhar ..... 53/558
3,507,087 A * 4/1970 Pratt ..... 53/455
3,608,566 A * 9/1971 Storandt ..... 383/38
3,827,552 A * 8/1974 Janhonen ..... 383/38
3,915,297 A * 10/1975 Rausch ..... 53/450
4,196,562 A * 4/1980 Hirschman ..... 53/450
4,256,256 A * 3/1981 Meyers ..... 53/450
4,702,378 A * 10/1987 Finkel et al. ..... 383/38
4,927,405 A * 5/1990 Martin et al. ..... 383/38
5,024,536 A * 6/1991 Hill ..... 383/38
6,550,966 B1 * 4/2003 Saad et al. ..... 383/103
6,579,008 B2 * 6/2003 Price et al. ..... 383/38

* cited by examiner

*Primary Examiner*—Louis K Huynh
(74) *Attorney, Agent, or Firm*—Terrell P. Lewis (Attorney)

(57) ABSTRACT

A container and a method of making the container are disclosed. The process consists of arranging two sheets of material in face-to-face relationship with mating fastening elements carried by the sheets being disposed adjacent one another. Three sides of the sheets are sealed together to form an enclosure, a product is placed in the enclosure, the fastening elements are engaged to seal the fourth side of the sheets, the sealed enclosure is folded over on itself and a second product is placed between the now facing sides of the enclosure, and the folded over enclosure is sealed with a breakable seal disposed outside of the first seal such that the first and second products are captured and sealed within the so-formed container. An embodiment of the container is disclosed which comprises a diaper changing kit enclosing a diaper and at least one of a variety of baby changing accessories.

5 Claims, 3 Drawing Sheets

FIG. 5
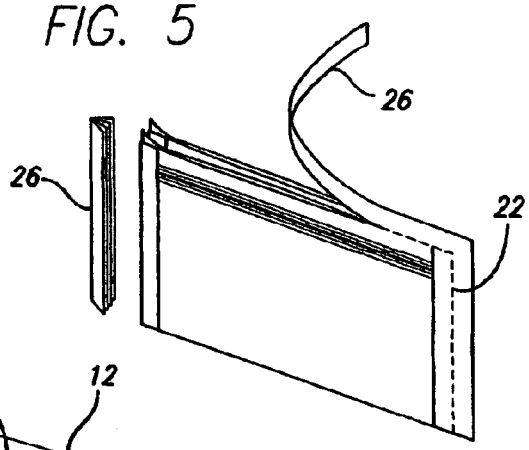
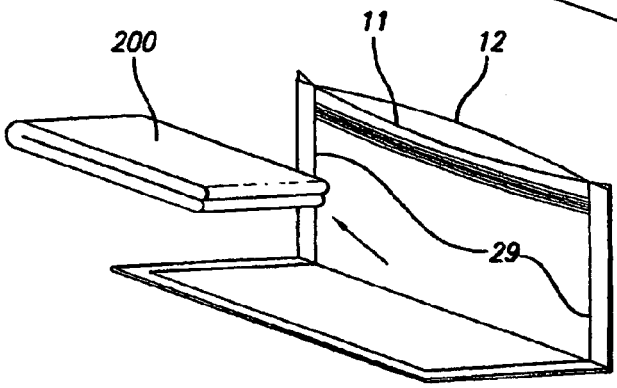
FIG. 6
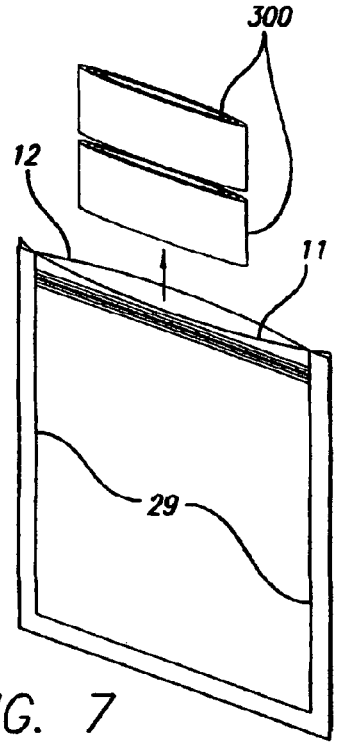
FIG. 7

FIG. 8
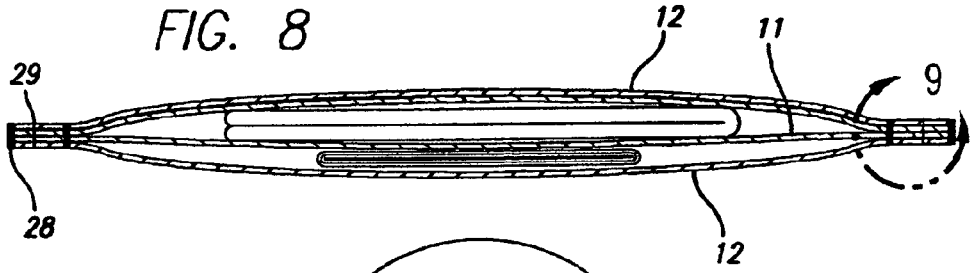
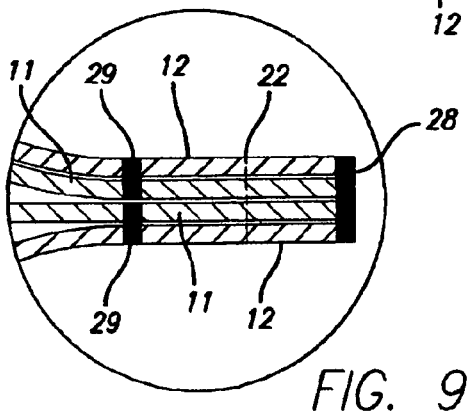
FIG. 9
FIG. 10
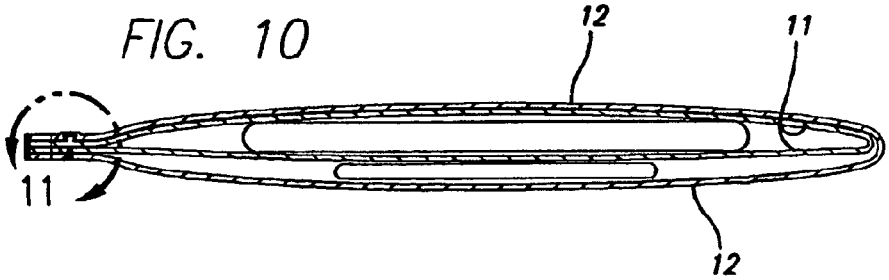
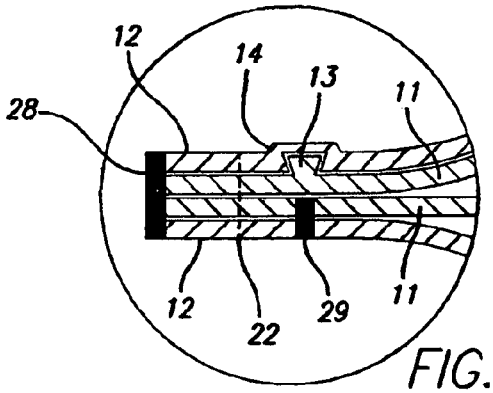
FIG. 11

RESEALABLE PACKAGE

This application is a division of U.S. Ser. No. 10/747,629 filed Dec. 29, 2003, now U.S. Pat. No. 7,204,368.

FIELD OF THE INVENTION

The present invention relates generally to packages or containers with resealable openings, and more particularly to a flexible package or container having a plurality of compartments each containing its own product, seals for keeping the products separate and enveloped within their respective compartments, and a resealing mechanism for resealing the products or their refuse in the container after use. Even more specifically, the container of the invention has a primary enclosure with a first seal extending about the periphery and into which one or more first products can be inserted, and a secondary enclosure for holding related items which is formed when the primary enclosure is folded over on itself and sealed with a second seal about its periphery. A set of perforated portions extending about the periphery of the folded over primary enclosure are removable to gain access to both the primary and secondary enclosures. Contents of the container could include childcare items (such as diapers, lotions, wipes, etc.), comestible items (such as sandwich fixings), first aid kit items (such as Band-Aids, salves, cotton, etc.).

BACKGROUND OF THE INVENTION

The prior art is replete with packages or containers that are made of pliable material and are used to store usable products, and which can be used as a discardable container to dispose of contained, used, items.

For example, U.S. Pat. No. 4,702,378 to Finkel et al. discloses a single use, disposable kit which receives and retains toiletries and a diaper for the care of a baby in a sanitary, tamper-proof manner. The kit is formed from a sheet of plastic material folded over upon itself at opposite ends and sealed along opposite side edges to form two principal pockets at opposite ends of the sheet. Two sheets of plastic are sealed to the outer surface of the kit to form secondary pockets for holding accessories useful in changing a baby's diaper. While the two sheets that form secondary pockets are attached to the kit via a seal, they are intended to be removed from the kit, nor is the seal intended to be broken to gain access to the contents in the secondary pockets.

U.S. Pat. No. 3,223,310 to Becker et al. discloses a container including an outer board member folded so as to form a bottom wall and side walls, with the side walls having extensions that, when folded over on one another, form a top wall. An inner flexible liner is disposed within the folded outer board member, and is formed in such a manner as to provide two pockets or pouches for holding product ready for dispensing when desired. The Becker et al. container does not provide a flexible package which, after using the contents, is capable of being reused to dispose of contaminated product, nor is there a teaching of a perforated package having portions removable to open the package.

European patent No. EP452-167-A to NAIN discloses a tobacco pouch made from a strip of pliable material that has pockets at its two ends and adhesive strips along the inner facing sides of the strip. The strip can be folded such that the two pockets wind up facing each other with respective opposing sides adhering to one another thereby releasably sealing the pouch. As with the Becker patent discussed above, however, this container does not provide a flexible package which, after using the contents, is capable of being reused to dispose of contaminated product, nor is there a teaching of a perforated package having portions removable to open the package.

U.S. Pat. No. 3,685,645 to Kawaguchi discloses a foldable package having a saddle bag configuration and including two pockets on opposite ends of a sheet of plastic and a bendable connecting portion between the two ends. Each pocket is provided with a transverse tear line so that the connecting portion between the two ends can be torn away and the pockets opened simultaneously.

Three further disclosures that teach providing pockets in packages include U.S. Pat. No. 4,892,512 to Branson, U.S. Pat. No. 4,702,378 to Finkel et al., and U.S. Pat. No. 5,388,699 to Ratajczak et al.

Other disclosures thought to be relevant include U.S. Pat. No. 3,506,759 to Wilton, U.S. Pat. No. 5,137,154 to Cohen, U.S. Application Publication No. U.S. 2001/0030133 A1 to Shibata, U.S. Application Publication No. U.S. 2001/0005435 A1 to Harmanoglu, U.S. Pat. No. 2,699,779 to Lustig, U.S. Pat. No. 4,776,455 to Anderson et al., and U.S. Pat. No. 3,223,310 to Becker et al., all of which disclose resin sheets folded and secured to provide packages of various shapes having pockets, but none of which disclose resealable enclosures or pockets within pockets or enclosures.

None of these documents known to applicants disclose or teach a container or package of the kind invented by applicants—that is, a principal enclosure having a resealable pocket for receipt of one or more commodities of a first group inside, where the principal enclosure is folded upon itself to create a second enclosure between opposing faces of which one or more commodities of a second group are disposed.

In one aspect of the invention, the package or container of the invention includes mating seal element on facing inner sides of the principal enclosure which are capable of being selectively engaged or released.

In another aspect of the invention, once the principal enclosure has been filled with the desired product(s) and sealed, and one or more products from the second class have been placed between adjacent faces of the folded container, a seal is formed about the about the container along a seal path that extends parallel to the outer edges of the folded enclosure so that the products from the first and second groups of components are enclosed in a sealed package.

In still another aspect of the invention, the seal extending about the container along the seal path extending parallel to the outer edges of the folded container is a perforated seal which enables removal of an outer peripheral strip of the container to permit access to the contents in the container.

The present invention therefore is a package or container comprising a primary bag-like enclosure for housing one or more items from a first group of commodities and having sealable elements at a mouth region thereof where the primary enclosure is folded upon itself once the item(s) have been placed inside to form a secondary enclosure about the periphery of which is provided an outer seal. A second perforated seal spaced inwardly from the outer seal is formed along a seal path disposed parallel to and about the three non-folded sides of the secondary enclosure. The perforated seal enables removal of an outer margin of the otherwise sealed container defined outwardly of itself, whereupon the container can be opened and the contents removed for use. Preferably before the secondary enclosure is sealed, one or more items of a second group of commodities are placed between adjacent sides of the folded container. Preferably, the commodities of the first and second classes are complementary in nature.

BRIEF DESCRIPTION OF THE DRAWINGS

FIG. 5 shows the container or package according to the present invention being opened;

FIG. 6 shows an article being removed from between two adjacent sides of the partially unfolded container or package;

FIG. 7 shows two other components of the packaged goods being removed from within the container or package;

FIG. 8 is a cross-sectional view of the folded container or package shown in FIG. 4, taken along section lines 8-8;

FIG. 9 is an enlarged view of one side of the container shown in FIG. 8, taken at the section shown at 9-9;

FIG. 10 is a cross-sectional view of the folded container or package shown in FIG. 4, taken along section lines 10-10; and FIG. 11 is an enlarged view of the top of the container or package shown in FIG. 4, taken along section lines 11-11 in FIG. 10.

DETAILED DESCRIPTION OF THE INVENTION

Figure 1:
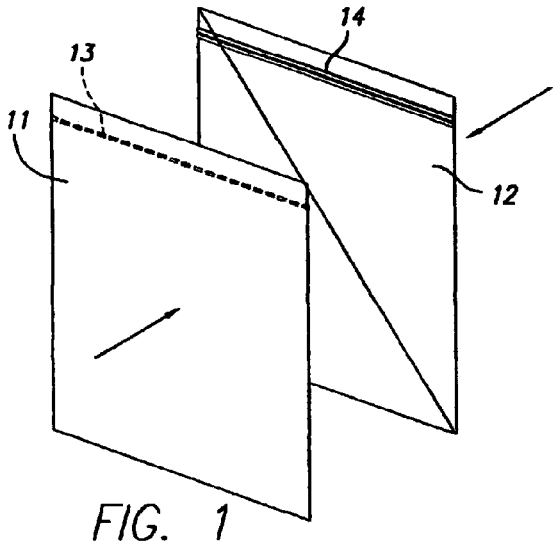
FIG. 1 illustrates two sheets of plastic material from which the container of the present invention is formed.
Figure 2:
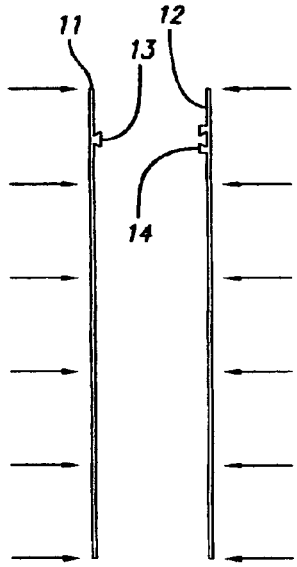
FIG. 2 is a side view of the two sheets shown in FIG. 1.
Figure 3:
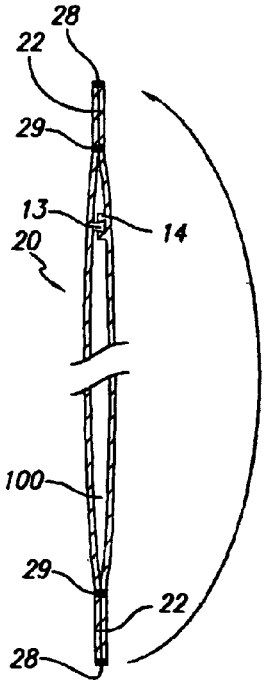
FIG. 3 shows the two sheets adhered together with an indication of how the container of the present invention is to be formed.

Referring first to FIGS. 1-3 of the drawings, the container or package of the present invention is formed in a multi-phase process. First, two sheets 11, 12 of flexible plastic material are arranged adjacent one another and a seal 29 is formed along a first seal path located parallel to, and inset from, the periphery of each of the three sides of the overlying sheets to produce a container 10 as shown in FIG. 3 (also a single sheet of material could be folded to yield two flat pieces). Preferably, the seal 29 is formed via the application of heat and pressure.

Adjacent to the fourth unsealed end region of each of the sheets 11 and 12 is attached a fastening element each of which cooperates with the other to effect fastening and unfastening (FIG. 2 shows a male fastening element 13 attached to sheet 11, and a female fastening element 14 attached to sheet 12). The fastening elements can also be of the type and material of which conventional "zip-lock" fasteners are made. Each fastening element can be attached to its respective sheet by application of a strong glue, or by heat and pressure, or a combination of glue, heat and pressure, or by laser welding, or by any other attaching process known in the art. The male element and the female element 13, 14 on the two sheets are arranged in such a manner as to face one another at correspondingly similar locations in the end regions of the two sheets, as is shown in FIG. 2 and to be operatively engagable to selectively effect a latching and unlatching attachment.

As shown in the side sectional view of FIG. 3, the two sheets of flexible plastic material are attached to each other to form the container or package 10. A principal enclosure 100 is formed between the two sheets with the male and female fastener elements 13,14 being disposed in such a position as to be able to cooperate with one another to permit engagement, or subsequent disengagement, of the fastener elements so that the interior of the principal enclosure 100 can be selectively sealed off, or accessed, respectively. The purpose of accessing the interior of the principal enclosure is to be able to insert or remove one or more items from a first set of "consumable" commodities that will be enclosed, and are being offered for use, in the package.

Figure 4:
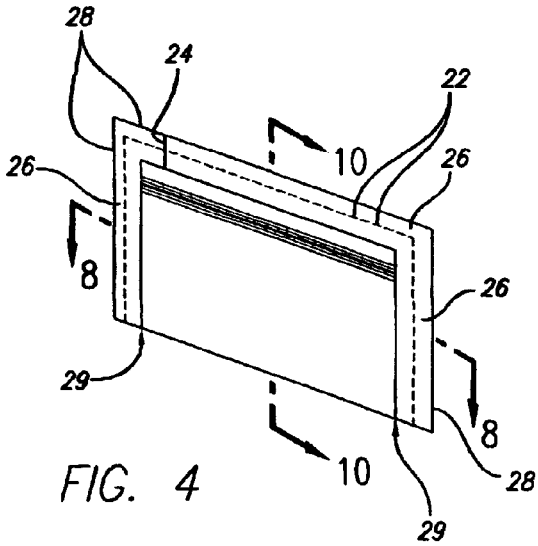
FIG. 4 shows a container or package after its formation.

FIG. 4 shows the container depicted in FIG. 3 essentially folded in half, with the upper left side of the container shown in FIG. 3 being visible to the viewer in FIG. 4. The folded container shown in FIG. 4 is obtained folding the lower end portion of the container shown in FIG. 3 about a middle region of the container in the direction of arrow P so that the lower end portion of the container becomes disposed in registry with the upper end portion of the container. It is to be understood that this reference to "upper" and "lower" end portions of the container is for purposes of explanation only, since the same end result can be accomplished whether the container is initially oriented horizontally, obliquely, or vertically.

Prior to effecting the seal path 22, one or more items from a first set of the "consumable" products is placed within the enclosure 100 before the fastening elements 13, 14 are attached together. After folding the container essentially in half, another item from a second set of "consumable" commodities is placed between the "upper" end portion of the container and the "lower" end portion of the container, after which the adjacent free edges of the "upper" and "lower" end portions of the container are sealed, as shown at 28. Then, a seal path 22 is formed, comprising a perforated seal. The seal path 22 is disposed laterally inwardly from the sealed edges of the container, and laterally outwardly of the seal 29. Preferably, the perforated seals of the seal path 22 extend linearly between the "outer" seal 28 and the "inner" seal 29, and run about the peripheral region of the container substantially parallel to the three non-folded edges (sealed at 28) of the container. Formation of the seal path 22 results in the creation of a margin of material 26 located between the seal path 22 and the sealed peripheral edges 28 of the container. Preferably, the seals of the seal path 22 are frangible and disposed at closely spaced adjacent locations. Further, the seals of the seal path 22 are located within the margin 24 and function to secure the upper and lower end portions of the container together.

FIG. 5 shows the manner in which the fully assembled and sealed package is opened after the desired consumable products have been placed inside. First, the outer margin of material 26 of the package must be removed. This is accomplished by grabbing hold of one edge portion of the outer margin 26 on one side of the package near the folded portion of the package, and pulling the edge portion of the outer margin 26 outwardly and away from the package to separate it, along the perforated seal, from the package. The pulling force exerted on the outer margin edge portion causes the edge portion to separate from the package along the perforated seal path adjacent the package sides and top as shown in FIG. 6. It is to be noted that the edge portion on the left side of the package shown in FIG. 6 has been separated or broken off from the rest of the edge portion at the top and opposite side of the package; however, it is also possible that the entire strip of the margin 26 disposed about all three edges can be removed as one continuous element, or that the margin 26 can be removed in more than two pieces, taking into account that the margin strip may break or tear as it is being removed. Once the edge portion has been totally separated from the body of the container, it can be discarded if a refuse receptacle is close at hand, or later disposed of by placing it in the pocket 100 along with other refuse (left-over, soiled or used commodities) or containers in which the consumable products are housed (if any) and discarding the container 100 after closing the fasteners 13, 14.

Next, as shown in FIG. 6, the container is unfolded by moving the upper and lower end portions away and apart from one another, and the previously captured second consumable item 200 contained therebetween is available for removal and use.

Following removal of the second consumable item or product, the cooperating "zip-lock" fasteners can be separated and the enclosure 100 opened so that the first consumable product (s) 300 can be removed from in the container (see FIG. 7).

Finally, after all of the consumable products have been used (as discussed above), any refuse or other discard can be placed back in the primary enclosure 100 of the container and the "zip-lock" type fasteners at the upper end portion of the container can be closed again to reseal the refuse in the container. Then, the container and refuse can be discarded in an appropriate receptacle, such as a trash can.

FIG. 8 is a cross-sectional view taken through the container of the present invention at section lines 8-8 in FIG. 4 and showing the contents of the container in their separate enclosures and the seals at opposite lateral ends of the container.

FIG. 9 is an enlarged sectional view of one lateral edge of the container taken at the circular sectional area designated with the numeral 9-9 in FIG. 8. In the FIG. 9 depiction, the lateral edge of the container is seen to include the sealed outer edge 28 of the container and the heat sealed seam 29 disposed inwardly of the edge 28. Disposed between the edge 28 and the seam 29 is the perforated seal 22.

FIG. 10 is a cross-sectional view taken through the container of the present invention at section lines 10-10 in FIG. 4 and showing the contents of the container in their separate enclosures and the seals at the upper portion (i.e., the left side of FIG. 4) of the container.

FIG. 11 is an enlarged sectional view of one lateral edge of the container taken at the circular sectional area designated with the numeral 11-11 in FIG. 10. In the FIG. 10 depiction, the upper edge of the container is seen to include the sealed outer edge 28 and one heat sealed seam 29 disposed inwardly of the edge 28. The engaged male and female fastening elements 13 and 14 (which were disposed at the top of the unfolded enclosure shown in FIG. 3) are seen to be disposed directly opposite the heat sealed seam 29 in folded enclosure shown in FIG. 11. FIG. 11 shows that disposed between the edge 28 and the seam 29, as well as the engaged elements 13,14 and the edge 28, is the perforated seal 22.

"Consumable" commodities of the first and second sets could include diaper changing items, sandwich making items, feminine hygiene items, first aid items, etc.

Those skilled in the art will appreciate that various adoptions and modifications of the invention as described above can be configured without departing from the scope and spirit of the invention. Therefore, it is to be understood that, within the scope of the appended claims, the invention may be practiced other than as specifically described herein.

We claim:

1. A process of making a product containing enclosure, comprising:

forming a first seal by sealing the edges of three sides of first and second sheets of material adjacent each other in facing relationship to form an enclosure, each of said sheets having mating fasteners arranged face-to-face at the fourth side, disposing a first product in said enclosure and sealing the fourth side of said enclosure, folding the enclosure over on itself and placing a second product between facing sides of the folded enclosure, and sealing the folded-over enclosure along the free edges thereof to thereby form a second enclosure containing said first and second products.

2. The process of claim 1, wherein the step of sealing the folded-over enclosure along the free edges thereof includes the step of providing a breakable seal outside of the first seal.

3. The process of claim 2, wherein said step of sealing said free edges with a breakable seal includes the step of forming a perforated temporary seal along a seal path that extends parallel to each of the free edges.

4. A process of making a container, comprising:

providing first and second sheets of material, securing a male fastener on a surface of said first sheet of material, securing a female fastener on a surface of said second sheet of material, said female fastener being configured to releasably engage said male fastener, disposing said sheets so that said surfaces of said first and second sheets face, and are spaced from, one another, aligning said sheets such that the fasteners are in registry with one another, securing said sheets together with a first seal to form an enclosure closed on at least three sides, said fastener elements registering, and being engagable, with each other, disposing a first product in said enclosure, engaging said fastener elements to seal said enclosure on said fourth side, folding said enclosure upon itself so that the free ends portions of the folded enclosure overly one another, disposing a second product between the free end portions, and securing said free end portions about the periphery thereof with a breakable seal, said breakable seal being disposed outside of said first seal and enclosing said second product.

5. The process of claim 4, wherein said step of securing said free end portions about the periphery with a breakable seal includes the step of forming a perforated temporary seal along a seal path that extends parallel to free end of said periphery.

* * * * *